US005129369A

United States Patent [19]

Kawamura

[11] Patent Number: 5,129,369

[45] Date of Patent: * Jul. 14, 1992

[54] ELECTROMAGNETIC VALVE CONTROL SYSTEM

[75] Inventor: Hideo Kawamura, Samukawa, Japan

[73] Assignee: Isuzu Ceramics Research Institute Co., Ltd., Kanagawa, Japan

[ * ] Notice: The portion of the term of this patent subsequent to Dec. 17, 2008 has been disclaimed.

[21] Appl. No.: 638,727

[22] Filed: Dec. 20, 1990

[30] Foreign Application Priority Data

Dec. 20, 1989 [JP] Japan ..... 330104

[51] Int. Cl.[5] ..... F01L 9/04

[52] U.S. Cl. ..... 123/90.11; 123/315; 251/129.01

[58] Field of Search ..... 123/90.11, 90.15, 315; 251/129.01, 129.05, 129.09

[56] References Cited

U.S. PATENT DOCUMENTS 4,942,851 7/1990 Kawamura ..... 123/90.11

*Primary Examiner*—E. Rollins Cross
*Assistant Examiner*—Weilun Lo
*Attorney, Agent, or Firm*—Staas & Halsey

[57] ABSTRACT

A magnetic plate is disposed in confronting relation to the shank end of an auxiliary exhaust valve which is opened to discharge exhaust gases from a combustion chamber. The magnetic plate is attracted by an electromagnet into abutment against the shank end of the auxiliary exhaust valve, and forces the auxiliary exhaust valve in an opening direction. When the auxiliary exhaust valve is opened, the exhaust gases are discharged from the combustion chamber, and the pressure in the combustion chamber is quickly lowered. Forces required to open a main exhaust valve subsequently may thus be reduced.

3 Claims, 4 Drawing Sheets

ELECTROMAGNETIC VALVE CONTROL SYSTEM

BACKGROUND OF THE INVENTION

1. Field of the Invention

The present invention relates to an electromagnetic valve control system for controlling two exhaust valves, i.e., main and auxiliary exhaust valves, of an engine so that the auxiliary exhaust valve is opened prior to the main exhaust valve.

2. Description of Prior Art

Intake and exhaust valves of some conventional engines are opened and closed by a camshaft. The camshaft is operatively connected to the crankshaft of the engine, so that the timing of opening and closing the intake and exhaust valves with respect to the angle of the crankshaft cannot be varied as the rotational speed of the engine varies. Since the timing of opening and closing the intake and exhaust valves is adjusted in advance to achieve a high engine efficiency at a particular engine rotational speed, the engine efficiency is lowered when the engine rotates at speeds other than the particular engine rotational speed.

There has been proposed an engine whose intake and exhaust valves are opened and closed under electromagnetic forces produced by electromagnets. The timing of opening and closing the intake and exhaust valves can be varied as the rotational speed of the engine varies, so that the engine can operate with high efficiency at different rotational speeds.

In the proposed engine with the electromagnetic valve control system, the intake and exhaust valves themselves can be opened and closed under relatively small forces. When the exhaust valve is to be opened while the engine is in operation, however, a large force is required to be applied to the exhaust valve since the exhaust valve has to be moved against the pressure developed in the combustion chamber. Therefore, the electromagnet for actuating the exhaust valve is large in size, or the exhaust valve may not be opened due to the lack of a sufficient valve actuating force.

For example, if it is assumed that the pressure in the combustion chamber in the expansion stroke is 5 $Kg/cm^2$ and the surface area of the exhaust valve which faces the combustion chamber is 8 $cm^2$, then the electromagnetic force required to open the exhaust valve against the pressure in the combustion chamber is 40 Kg (392N). As the exhaust valve is also required to be accelerated when it is opened, an electromagnetic force of about 80 Kg (784N) must be generated by the electromagnet.

SUMMARY OF THE INVENTION

According to the present invention, there is provided an electromagnetic valve control system for electromagnetically opening and closing main and auxiliary exhaust valves in an engine, comprising a movable magnetic plate confronting a shank end of the auxiliary exhaust valve an electromagnet having a fixed magnetic pole confronting the movable magnetic plate, and energizable for causing the fixed magnetic pole to attract the movable magnetic plate in a direction to open the auxiliary exhaust valve, a spring for normally urging the auxiliary exhaust valve in a closing direction, and control means for energizing the electromagnet prior to operation of the main exhaust valve. At the timing to start discharging exhaust gases from a combustion chamber, the magnetic plate is attracted by an electromagnet into abutment against the shank end of the auxiliary exhaust valve, and forces the auxiliary exhaust valve in an opening direction. When the auxiliary exhaust valve is opened, the exhaust gases are discharged from the combustion chamber, and the pressure in the combustion chamber is quickly lowered. Forces required to open a main exhaust valve subsequently may thus be reduced.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
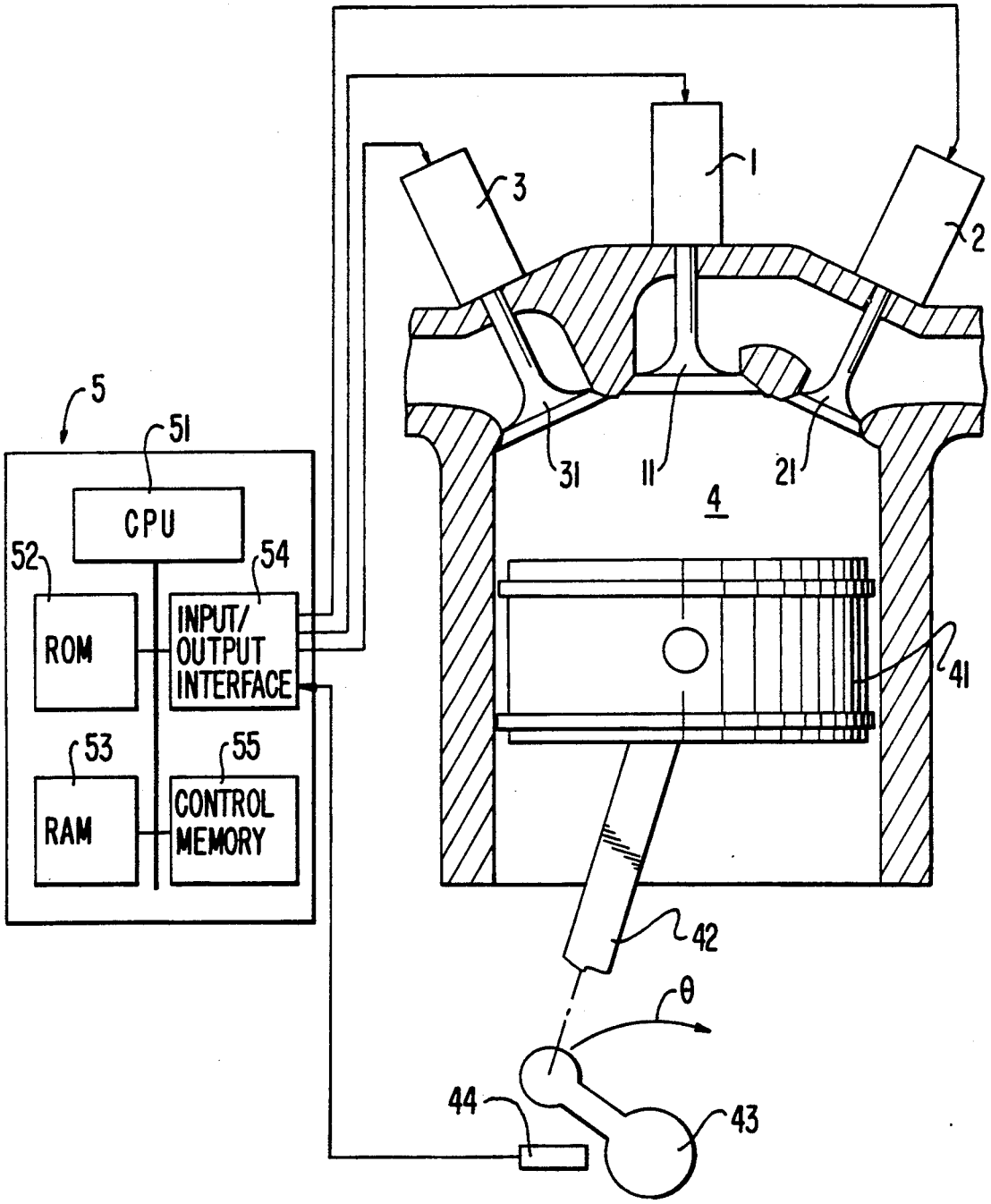
FIG. 1 is a cross-sectional view, partly in block form, of an engine incorporating an electromagnetic valve control system according to the present invention.

FIG. 1 shows an internal combustion engine which incorporates an electromagnetic valve control system according to the present invention.

The engine has a main exhaust valve 11 made of a lightweight high-hardness material such as a ceramic material or a heat-resistant lightweight alloy material. The main exhaust valve 11 has an axial end connected to a valve actuator 1 for opening and closing the main exhaust valve 11.

The engine also has an auxiliary exhaust valve 21 and an intake valve 31 which are disposed adjacent to the main exhaust valve 11. The auxiliary exhaust valve 21 has a valve head which is smaller in diameter than the valve head of the main exhaust valve 11. Each of the auxiliary exhaust valve 21 and the intake valve 31 is also made of a lightweight high-hardness material such as a ceramic material or a heat-resistant lightweight alloy material. The auxiliary exhaust valve 21 and the intake valve 31 have respective axial ends connected to respective valve actuators 2, 3 for opening and closing the auxiliary exhaust valve 21 and the intake valve 31, respectively.

The main exhaust valve 11, the auxiliary exhaust valve 21, and the intake valve 31 face a combustion chamber 4 which is partly defined by a piston 41 disposed therebelow. The piston 41 is coupled to the pin journal of a crankshaft 43 through a connecting rod 42. The rotational speed of the crankshaft 43 and the rotational angle 8 of the crankshaft of the engine are detected by a rotation sensor 44.

The rotation sensor 44 and the valve actuators 1, 2, 3 are electrically connected to an input/output interface 54 of a control unit 5. The input/output interface 54 receives signals from the rotation sensor 44 and applies control signals to the valve actuators 1, 2, 3. The control unit 5 also has a ROM 52 for storing a control program and various data maps, a CPU 51 for carrying out arithmetic operations according to the program stored in the ROM 52, a RAM 53 for temporarily storing data and the results of arithmetic operations, and a control memory 55 for controlling the flow of signals in the control unit 5.

The valve actuators 1, 2 will now be described below. The valve actuator 3 is identical in construction to the valve actuator 1, and hence will not be described.

the valve actuators 1, 2 in cross section.

Figure 2:
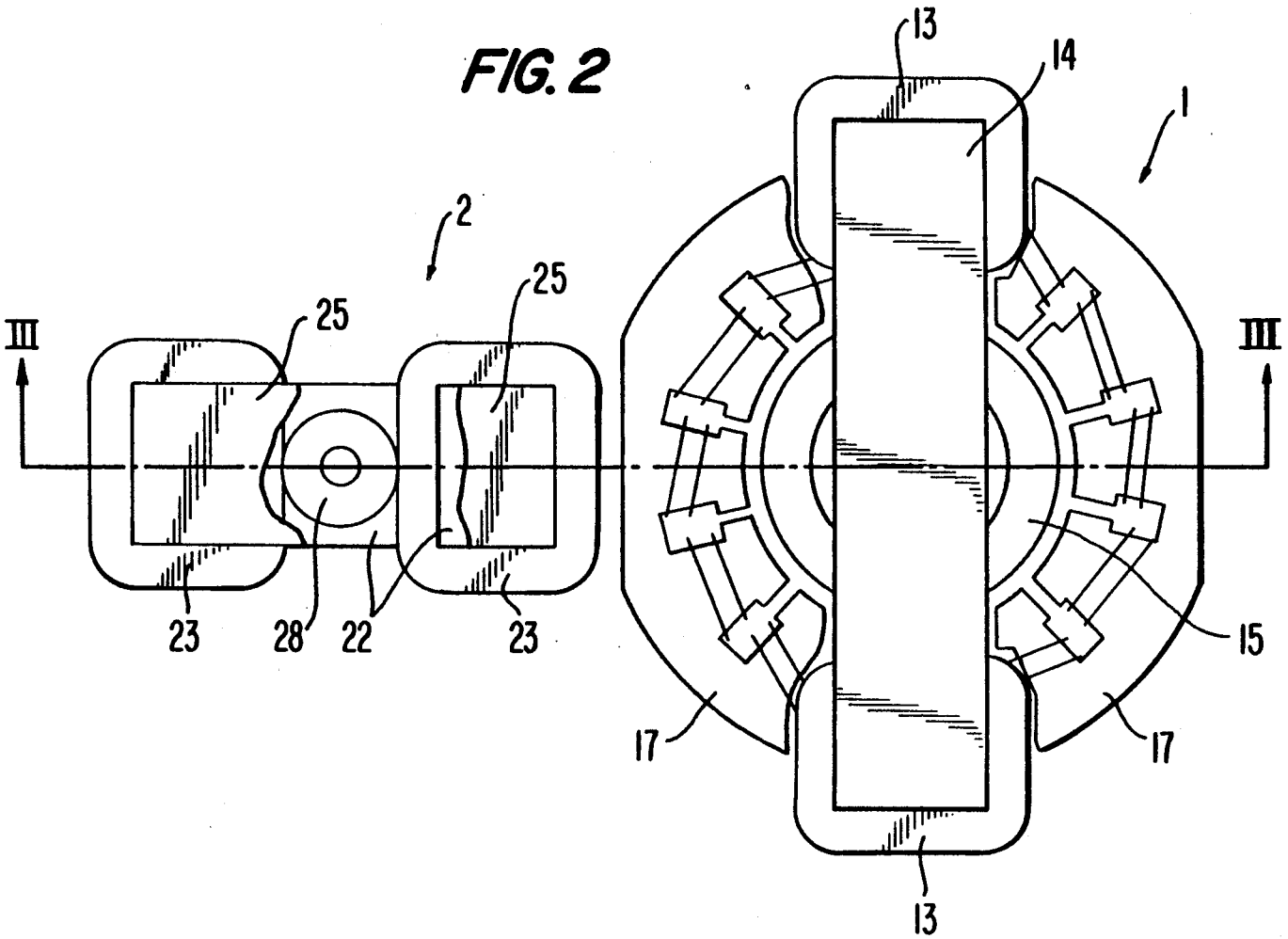
FIG. 2 is a plan view of valve actuators in the electromagnetic valve control system.
Figure 3:
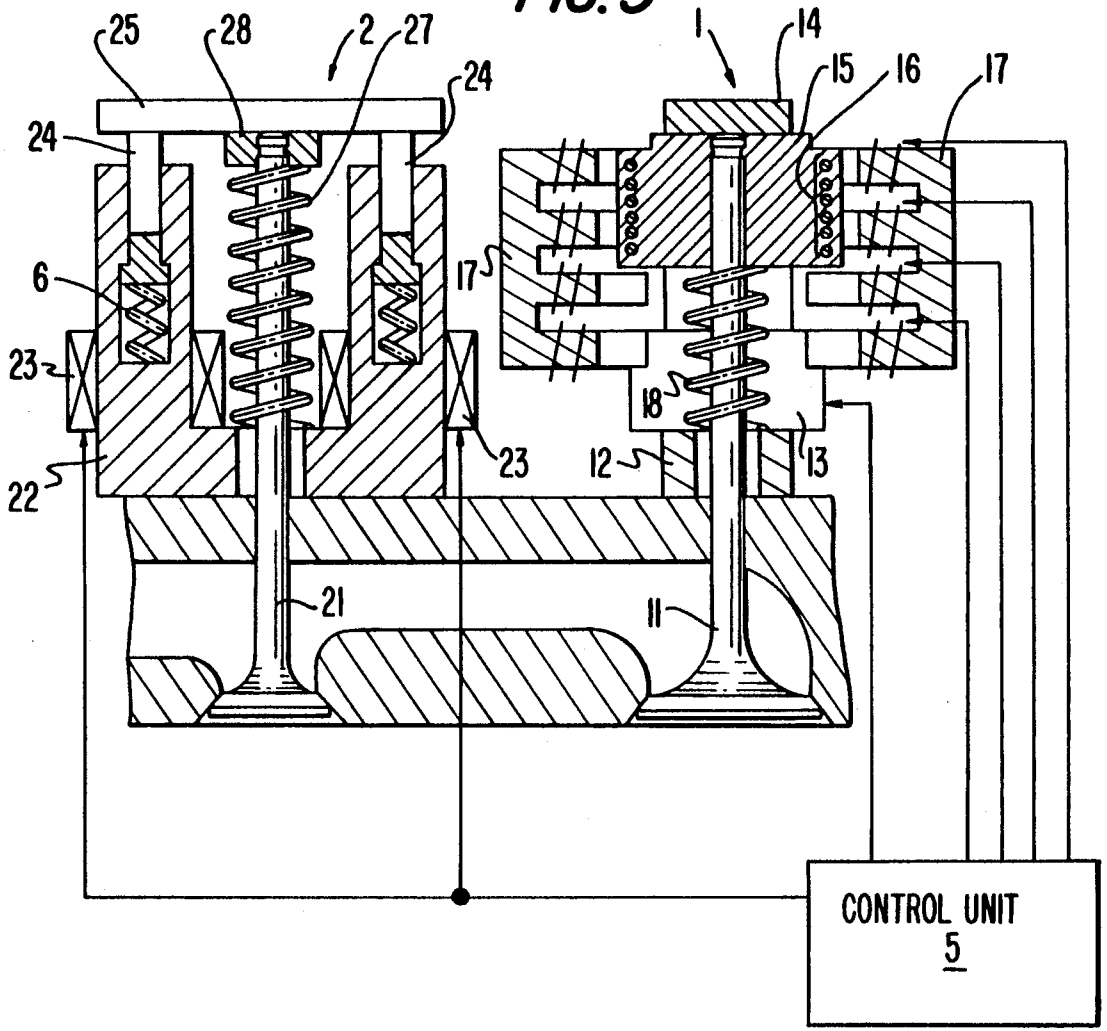
FIG. 3 is a cross-sectional view, partly in block form, taken along line III — III of FIG. 2.

As shown in FIGS. 2 and 3, the valve actuator 2 has a core 22 made of a magnetic material and having fixed magnetic poles positioned slightly below the upper shank end of the auxiliary exhaust valve 21 as it is closed. The fixed magnetic poles of the core 22 can be magnetized by an exciting coil 23. A magnetic plate 25 is slidably supported on the fixed magnetic poles by guide bars 24 of a nonmagnetic material. The guide bars 24 are normally urged to move upwardly as viewed in FIG. 3. When the magnetic plate 25 is in its upper limit position, it is slightly spaced from a stopper 28 mounted on the upper shank end of the auxiliary exhaust valve 21. The auxiliary exhaust valve 21 is normally urged to move upwardly under the bias of a spring 27 disposed under compression between the stopper 28 and the core 22.

The valve actuator 1 comprises a movable member mounted on the upper shank end of the main exhaust valve 11. The movable member comprises a cylindrical magnetic path element 15 and a plurality of secondary coils 16 extending around the outer circumference of the magnetic path element 15. The secondary coils 16 are produced by pouring melted aluminum into grooves defined in the outer circumference of the magnetic path element 15. The magnetic path element 15 is made of a magnetic material for increasing the flux density to act on the secondary coils 16. For example, the magnetic path element 15 comprises thin radial plates of a magnetic amorphous metallic material which are combined into a cylindrical shape. The magnetic path element 15 defines a magnetic path for the passage of magnetic fluxes from fixed magnetic poles (described later).

The movable member is normally urged by a spring 18 in a direction to close the main exhaust valve 11 in order to prevent the main exhaust valve 11 from dropping into the combustion chamber 4 while the engine is not operating.

A pair of actuator units 17 is disposed alongside of the movable member, one on each side thereof. Each of the actuator units 17 comprises fixed magnetic poles disposed in confronting relation to the secondary coils 16, and exciting coils wound around the respective fixed magnetic poles. The exciting coils are supplied with alternating currents from the control unit 5 to produce a traveling magnetic field which acts on the secondary coils 16 of the movable member.

Above the movable member, there is disposed a magnetic plate 14 which is slightly spaced from the movable member when the main exhaust valve 11 is seated. A lower electromagnet 12 is disposed also alongside of the movable member, the lower electromagnet having a pair of fixed magnet poles disposed one on each side of the main exhaust valve 11. The fixed magnetic poles of the lower electromagnet are positioned downwardly of the upper end surface of the movable member when the main exhaust valve 11 is closed. The lower electromagnet also has a lower coil 13 for magnetizing the fixed magnetic poles.

The magnetic plate 14 is reciprocally movably connected to the fixed magnetic poles of the lower electromagnet through guide bars of a nonmagnetic material. When the lower electromagnet is energized, the magnetic plate 14 is attracted thereby into abutment against the upper end of the movable member, thereby driving the movable member downwardly. The magnetic plate 14 is normally urged to move upwardly by springs (not shown).

Operation of the electromagnetic valve control system will be described below.

Figure 4:
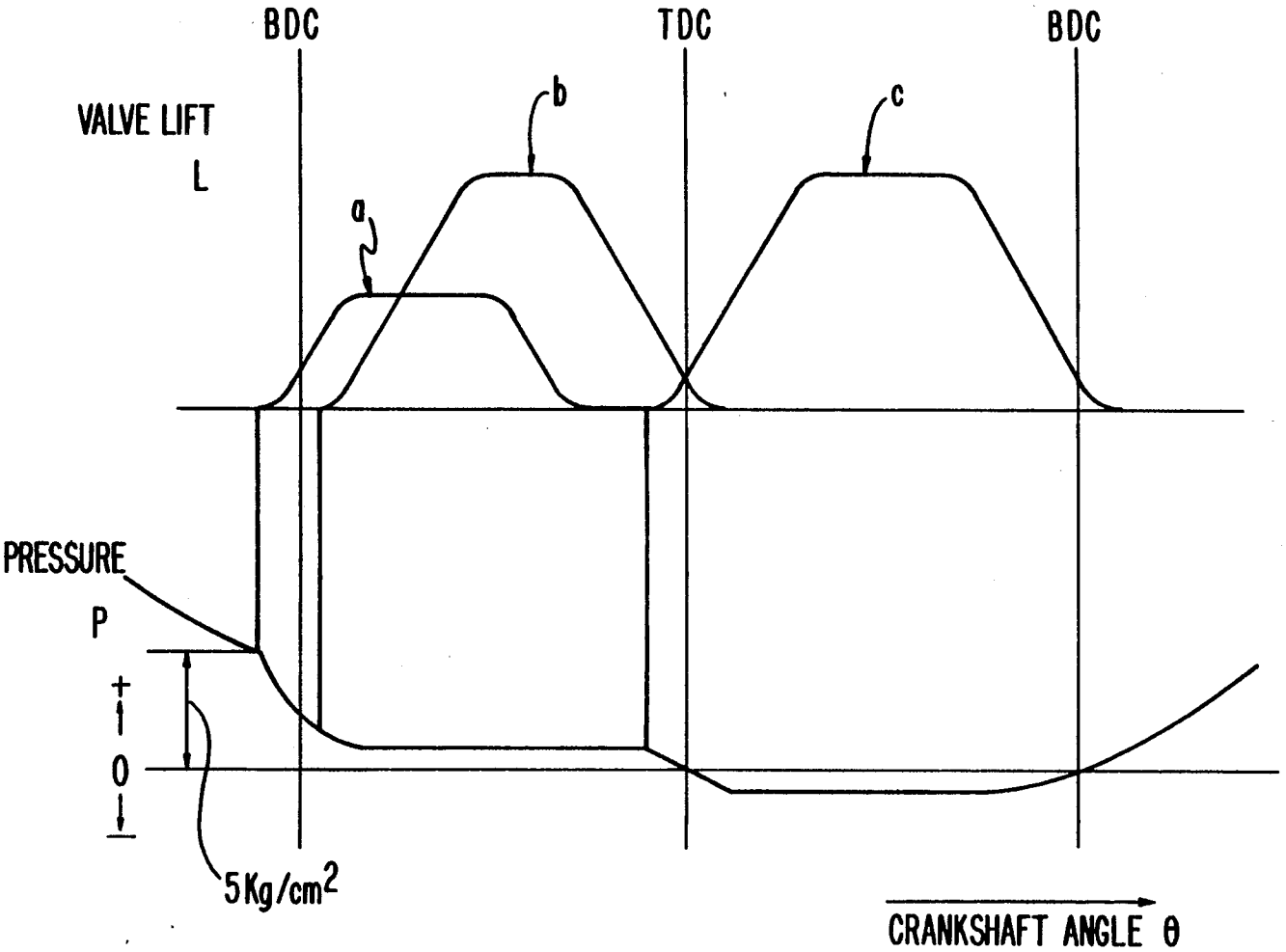
FIG. 4 is a diagram showing the relationship between the opening and closing of intake and exhaust valves and the pressure in a combustion chamber.

FIG. 4 shows the relationship between the opening and closing of the intake and exhaust valves and the pressure in the combustion chamber 4.

The curves shown in the upper side of the diagram of FIG. 4 correspond to cam profile curves. The horizontal axis of the diagram represents the crankshaft angle $\theta$ and the vertical axis the distance which the valves are moved, i.e., the valve lift L. The curve a shows the manner in which the auxiliary exhaust valve 21 is opened and closed, the curve b shows the manner in which the main exhaust valve 11 is opened and closed, and the curve c shows the manner in which the intake valve 31 is opened and closed. The curve in the lower side of the diagram indicates how the pressure P (gage pressure) in the combustion chamber 4 varies with respect to the crankshaft angle $\theta$, the pressure P being represented by the vertical axis.

When the crankshaft angle 8 detected by the rotation sensor 44 reaches the timing of starting to discharge the exhaust gases, as calculated by the control unit 5, the control unit 5 energizes the coils 23 to attract the magnetic plate 25 for thereby opening the auxiliary exhaust valve 21. Though the exhaust port opened by the auxiliary exhaust valve 21 is small in area, the exhaust gases are quickly discharged therethrough from the combustion chamber 4 since the pressure in the combustion chamber 4 is high.

After the auxiliary exhaust valve 21 is opened, and upon elapse of a certain crankshaft angle, the lower coil 13 is energized to attract the magnetic plate 14 for initially actuating the main exhaust valve 11. Then, the exciting coils of the actuator units 17 are supplied with alternating currents to move the main exhaust valve 11 in the opening direction through the coaction between currents induced in the secondary coils 16 and a traveling magnetic field produced by the fixed magnetic poles of the actuator units 17.

When the main exhaust valve 21 starts moving in the opening direction, the exciting coils 23 are de-energized, and the auxiliary valve 21 is closed under the bias of the spring 27.

When the directions in which the currents are supplied to the exciting coils of the actuator units 17 are reversed, the main exhaust valve 11 is moved in the closing direction until finally it is closed.

At the timing to start discharging exhaust gases, the pressure P in the combustion chamber 4 is about 5 $Kg/cm^2$. If the surface area of the auxiliary exhaust valve 21 which faces the combustion chamber 4 is 2 $cm^2$, then the electromagnetic force required to open the auxiliary exhaust valve 2 against the pressure in the combustion chamber 4 is only 10 Kg (98N). The accelerating force for the auxiliary exhaust valve 21 when it is opened may be smaller than the accelerating force for the main exhaust valve 11. When the auxiliary exhaust valve 21 is opened, since the pressure in the combustion chamber 4 is very high, the exhaust gases quickly flow out of the combustion chamber 4, and the pressure P immediately drops. After the pressure P has dropped, the main exhaust valve 11 is opened. Therefore, the valve actuator 1 is required to produce electromagnetic forces only large enough to accelerate the main exhaust valve 11. When the intake valve 31 is opened immediately before the piston 41 reaches the TDC (top dead center), since the pressure P remains low, the valve actuator 3 is also required to produce electromagnetic forces only large enough to accelerate the intake valve 31 as it is opened.

As described above, the valve actuators 1, 2, 3 are required to produce electromagnetic forces only large enough to actuate the respectively associated valves for the control of the opening and closing of the intake and exhaust valves.

While only one main exhaust valve 11 and only one auxiliary exhaust valve 21 are described, there may be employed a plurality of main exhaust valve 11 or a plurality of auxiliary valve 21 or both. The timing to start discharging the exhaust gases may be varied depending on the load on the engine.

Although a certain preferred embodiment has been shown and described, it should be understood that many changes and modifications may be made therein without departing from the scope of the appended claims.

I claim:

1. An electromagnetic valve control system for electromagnetically opening and closing main and auxiliary exhaust valves in an engine, comprising:

a movable magnetic plate confronting a shank end of the auxiliary exhaust valve;

an electromagnet having a fixed magnetic pole confronting said movable magnetic plate, and energizable for causing said fixed magnetic pole to attract said movable magnetic plate in a direction to open the auxiliary exhaust valve;

a spring for normally urging the auxiliary exhaust valve in a closing direction; and control means for energizing said electromagnet prior to operation of the main exhaust valve.

2. An electromagnetic valve control system according to claim 1, wherein said engine has a combustion chamber, said auxiliary exhaust valve having a surface area facing said combustion chamber and smaller than the surface area of the main exhaust valve which faces the combustion chamber.

,14

3. An electromagnetic valve control system according to claim 1, which includes a guide bar attached to said magnetic plate, said guide bar being movable in said fixed magnetic pole.

* * * * *

UNITED STATES PATENT AND TRADEMARK OFFICE

CERTIFICATE OF CORRECTION

PATENT NO. : 5,129,369

DATED : July 14, 1992

INVENTOR(S) : HIDEO KAWAMURA

It is certified that error appears in the above-identified patent and that said Letters Patent is hereby corrected as shown below:

Column 1, line 59, after "valve" insert a comma --,--.

Column 2, line 59, "8" should be --$\theta$--.

Column 3, line 8, before "the" insert --Fig. 2 shows--, after "in" insert --plan, and Fig. 3 shows the valve actuators 1, 2 in--.

Column 4, line 27, "8" should be --$\theta$--;

line 60, "2" should be --21--.

Column 6, line 21, delete ", 14";

line 23, after "which" insert --further--.

Signed and Sealed this

Twenty-third Day of November, 1993

*Attest:*

Bruce Lehman

BRUCE LEHMAN

*Attesting Officer*

*Commissioner of Patents and Trademarks*